US009938934B2

(12) United States Patent
Lazich et al.

(10) Patent No.: US 9,938,934 B2
(45) Date of Patent: Apr. 10, 2018

(54) EXHAUST GAS RECIRCULATION

(75) Inventors: Ivan M. Lazich, Chicago, IL (US); Dean Alan Oppermann, Plainfield, IL (US); Marton Gyuro, West Chicago, IL (US); Francis Lackner, Northbrook, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 165 days.

(21) Appl. No.: 14/408,831

(22) PCT Filed: Jun. 26, 2012

(86) PCT No.: PCT/US2012/044215

§ 371 (c)(1),
(2), (4) Date: Dec. 17, 2014

(87) PCT Pub. No.: WO2014/003723

PCT Pub. Date: Jan. 3, 2014

(65) Prior Publication Data

US 2015/0192095 A1 Jul. 9, 2015

(51) Int. Cl.

| | |
|---|---|
| ***B01F 3/02*** | (2006.01) |
| ***B01F 15/02*** | (2006.01) |
| ***F02M 25/07*** | (2006.01) |
| ***F02M 26/19*** | (2016.01) |

(52) U.S. Cl.

CPC ..... *F02M 25/0722* (2013.01); *B01F 3/02* (2013.01); *B01F 15/0248* (2013.01); *F02M 26/19* (2016.02); *B01F 2215/0085* (2013.01)

(58) Field of Classification Search

CPC ..... B01F 15/0248; B01F 2215/0085; F02M 25/0722; F02M 26/19

See application file for complete search history.

(56) References Cited

U.S. PATENT DOCUMENTS

| | | | | | |
|---|---|---|---|---|---|
| 475,297 | A * | 5/1892 | Coates | B05B 1/3006 | 239/104 |
| 4,270,576 | A * | 6/1981 | Takeda | B01F 5/0451 | 137/888 |
| 4,445,487 | A * | 5/1984 | Higashi | F02M 26/19 | 123/568.17 |
| 4,564,504 | A * | 1/1986 | Sorber | B01J 19/0013 | 165/82 |

(Continued)

*Primary Examiner* — Tony G Soohoo

(74) *Attorney, Agent, or Firm* — Jeff P. Calfa; Jack D. Nimz

(57) ABSTRACT

An fresh air/exhaust gas compact mixer and method for mixing fresh air with exhaust gases, is provided. The mixer includes a main body, an air inlet for receiving fresh air fluidly connected to an air intake passage within the main body, an exhaust gas inlet for receiving exhaust fluidly connected to an exhaust gas passage within the main body. The mixer also includes a bifurcation within the air intake passage for directing the flow of air through the passage, wherein the bifurcation decreases a cross section of the air intake passage downstream from the air inlet, thereby increasing the air velocity exiting the air intake passage. The narrowed cross section creates a localized vacuum, encouraging an increased flow of exhaust gas through the mixer, and creating superior mixing of the fresh air with the exhaust gases prior to exiting the mixer.

6 Claims, 4 Drawing Sheets

(56) References Cited

U.S. PATENT DOCUMENTS 4,648,373 A * 3/1987 Noguchi ..... F02M 26/19 123/184.38
6,044,827 A * 4/2000 Pfaff ..... F02B 47/08 123/568.18
6,425,382 B1 * 7/2002 Marthaler ..... F02M 26/19 123/568.17
6,427,671 B1 * 8/2002 Holze ..... B01F 5/045 123/568.17
6,439,212 B1 * 8/2002 Coleman ..... F02D 9/104 123/568.17
6,449,947 B1 * 9/2002 Liu ..... B01D 53/9431 60/286
6,513,508 B2 * 2/2003 Fischer ..... F02M 35/10118 123/568.17
6,659,092 B2 * 12/2003 Coleman ..... F02M 26/19 123/568.17
6,672,292 B2 * 1/2004 Fischer ..... F02M 35/10118 123/568.17
6,886,544 B1 * 5/2005 Bui ..... F02M 35/10118 123/568.17
7,059,118 B2 * 6/2006 Ripper ..... B01F 5/0268 60/286
7,140,357 B2 * 11/2006 Wei ..... F02B 29/0425 123/568.17
7,798,135 B2 * 9/2010 Bischofberger . F02M 35/10118 123/568.11
7,971,579 B2 * 7/2011 Heald ..... F02M 26/19 123/568.17
8,033,714 B2 * 10/2011 Nishioka ..... B01D 53/8631 137/888
8,757,133 B2 * 6/2014 Czapka ..... F02M 21/042 123/27 GE
8,925,529 B2 * 1/2015 van Hal ..... F02M 35/10052 123/568.17
8,950,383 B2 * 2/2015 Sperry ..... F02M 21/042 123/527
9,488,098 B2 * 11/2016 Sponsky ..... F02B 47/08
2002/0088443 A1 * 7/2002 Marthaler ..... F02M 26/19 123/568.17
2002/0162322 A1 * 11/2002 Ganzmann ..... B01D 53/79 60/286
2003/0072214 A1 * 4/2003 Fleischli ..... B01F 5/0473 366/175.2
2005/0161028 A1 * 7/2005 Wolters ..... B01F 5/0413 123/527
2006/0092758 A1 * 5/2006 Ellmers ..... B01F 5/0426 366/163.2
2006/0124116 A1 * 6/2006 Bui ..... F02B 37/013 123/568.18
2006/0245296 A1 * 11/2006 Nishioka ..... B01D 53/8631 366/174.1
2011/0061634 A1 * 3/2011 Sponsky ..... F02B 47/08 123/568.17
2011/0192383 A1 * 8/2011 Morais ..... F02M 35/10222 123/568.17
2012/0048246 A1 * 3/2012 Takagi ..... F02M 26/06 123/568.15
2015/0192095 A1 * 7/2015 Lazich ..... F02M 25/0722 366/163.2
2016/0160804 A1 * 6/2016 Dettloff ..... F02M 25/0722 123/568.17

* cited by examiner

EXHAUST GAS RECIRCULATION

TECHNICAL FIELD

The present disclosure relates generally to air-exhaust mixers used in exhaust gas recirculation for engines, and more specifically to a venturi-style, compact air-exhaust mixer.

BACKGROUND

Exhaust gas recirculation (EGR) is used to reduce pollution generated by engines and other combustion devices. EGR strategies reduce the oxygen content of the intake air charge by diluting it with an inert gas, such as exhaust. When the diluted air-exhaust mixture is used in place of ordinary air to support combustion in the engine, lower combustion and exhaust temperatures result. EGR also improves fuel economy in gasoline engines by reducing throttling losses and heat rejection.

With EGR, a portion of the exhaust gas generated by the engine is mixed into the air intake. Mixers typically add exhaust gas to the air flow somewhere in the middle of the air stream and rely on length or geometric features, such as bumps of fins, to induce mixing. These typical air-exhaust mixer assemblies occupy a large amount of space so as to ensure that the exhaust gas and intake air are completely mixed. Incomplete mixing of the air and exhaust gases can lead to an uneven distribution of EGR among the cylinders. To ensure complete mixing of the gases, typical venturi type mixers have long mixing cavities. An intake throttle may be used in some cases to increase the pressure differential between the EGR gas and the compressed fresh air. Other types of mixers have mixing cavities with large lengths, widths and/or heights in order ensure complete mixing of the gases. These large mixers in turn make retrofitting of air-exhaust mixers to engines quite expensive, because the plumbing of the engine has to be extensively modified in order to accommodate the large air-exhaust mixers. Another problem is that larger mixers significantly reduce the pressure of the mixed gas supplied to the engine.

Engines and diesel engines in particular, can benefit from EGR mixers which promote the maximum amount of mixing while causing the least amount of restriction possible in both the EGR and the air circuits. Mixing is necessary to ensure that there is as little variation as possible in EGR content from cylinder to cylinder that could cause poor emissions and performance results. Efficient mixing often results in increases in gas flow restrictions. Restrictions in either of the EGR or fresh air passages can result in reduced fuel economy.

The present device provides a compact venturi mixer, which overcomes the above disadvantages by providing an enhanced mixing feature. The present device promotes a maximum amount of mixing between the EGR gases and fresh air, while causing the least amount of restriction possible in both the EGR exhaust gas flow and fresh air flow.

SUMMARY

There is disclosed herein an improved venturi air-exhaust mixer unit and method of mixing intake air and recirculated exhaust gas prior to returning the mixture to the engine, which avoids disadvantages of prior devices, while affording additional structural and operating advantages.

In an embodiment, air-exhaust mixer is disclosed. The mixer comprises a main body, an air inlet for receiving fresh air fluidly connected to an air intake passage within the main body, an exhaust gas inlet for receiving exhaust fluidly connected to a exhaust gas passage within the main body, a bifurcation within the air intake passage for directing the flow of air through the passage, wherein the bifurcation decreases a cross section of the air intake passage downstream from the air inlet increasing the air velocity exiting the air intake passage, and a mixture outlet fluidly connected to air intake passage and the exhaust gas passage for combining the air with the exhaust gas prior to exiting the mixer.

In an embodiment, the bifurcation includes a main section connected to a widening branch section, wherein the branch section narrows the cross section of the downstream air intake passage creating a vacuum.

A method for creating a mixture of exhaust gas with intake air for use in an exhaust gas recirculation device of an engine is disclosed. The method comprises the steps of supplying fresh air through an air intake to an air passage, supplying exhaust gas through an exhaust intake to a centralized exhaust passage, providing an air/exhaust mixing outlet having a mixing zone downstream from the air intake and the exhaust intake, bifurcating the air flow through the air passage, creating a high velocity air flow through the air passage from the air intake to the mixing outlet and, mixing the air from the air passage with the exhaust gas from the exhaust passage creating an air-exhaust gas mixture within the mixing zone prior to returning the mixture to the engine.

DETAILED DESCRIPTION

Referring now to FIGS. 1-7, there is an air-exhaust mixer 10 of the present disclosure. Generally, and as know in the art, the air-exhaust mixer 10 of the present disclosure is used in conjunction with the exhaust gas recirculation (EGR) system of an engine or other combustion device. In one embodiment, the engine may be a diesel engine. Although not shown in the present application, an EGR system may also include an EGR valve, EGR valve housing and EGR connector. The operation of the EGR system is generally well-known to those skilled in the art.

Figure 1:
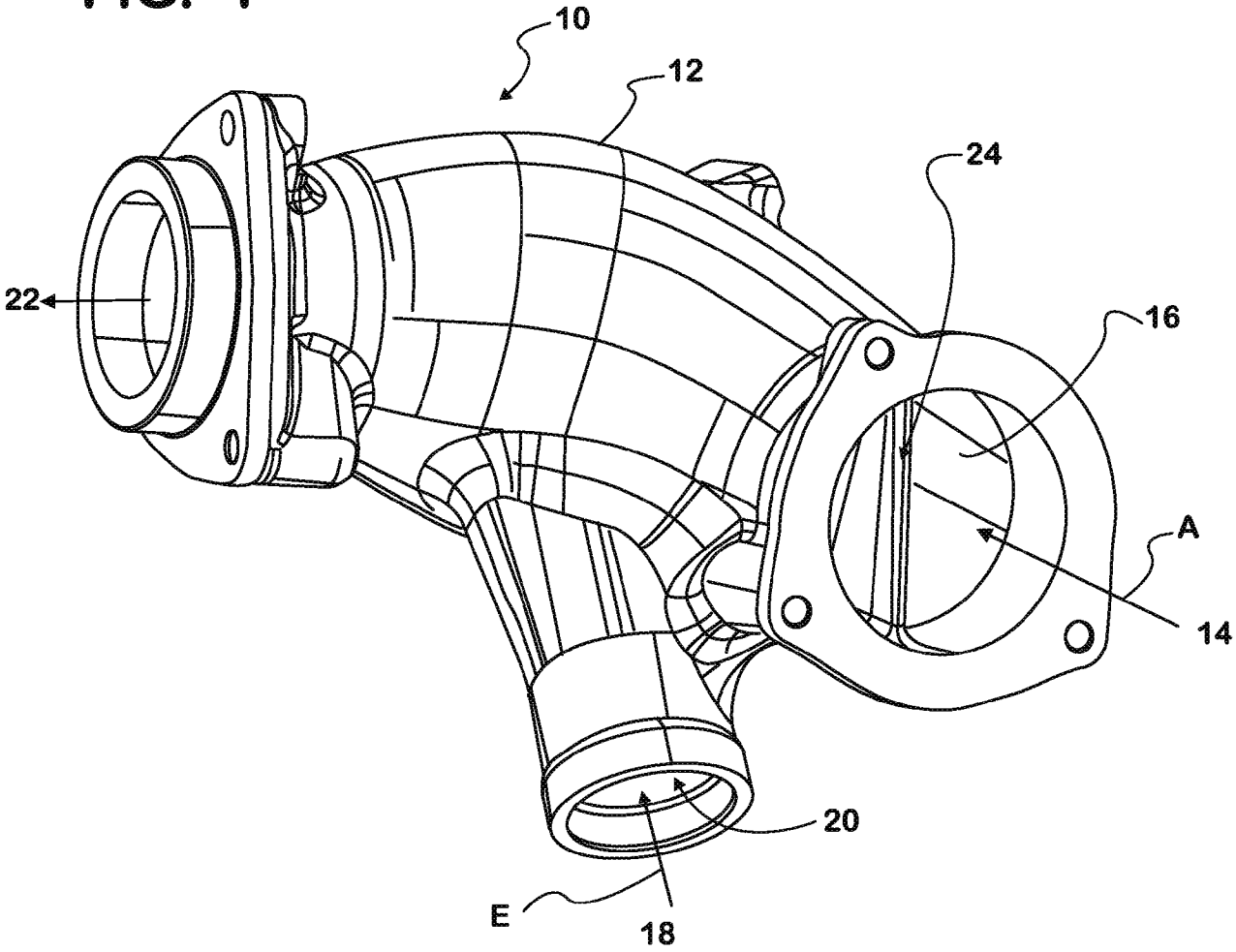
FIG. 1 is a perspective view of the present EGR air-exhaust mixer.
Figure 2:
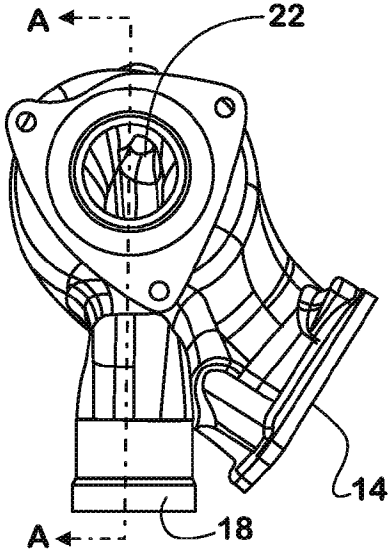
FIG. 2 is a front view of the present EGR air-exhaust mixer.

As shown in FIG. 1, the present air-exhaust mixer 10 includes a main body 12 with an air intake or air inlet 14 fluidly connected to an air passage 16, and a separate exhaust gas intake or exhaust gas inlet 18 fluidly connected to an exhaust passage 20. The air inlet 14 provides fresh air, filtered or unfiltered to the air passage, while exhaust gas enters the assembly and the exhaust passage 20 through the exhaust gas inlet 18. The two passages 16, 20 meet at a downstream an air-EGR mixture outlet 22, where the fresh air from the air passage mixes with the exhaust gas from the exhaust passage in a mixing zone 23 prior to returning to the engine (not shown). The mixer 10 may be constructed from a single casting, or as a fabricated assembly, depending on system requirements. The mixer and its functions will now be described in further detail in conjunction with the figures.

A primary function of the mixer 10 is to encourage superior mixing while creating a localized vacuum, which permits larger quantities of EGR gas to be delivered to the mixer with lower restriction of the main fresh air flow through the mixer. Mixers typically add EGR gas to the air flow somewhere in the middle of the air stream and rely on length or geometrical features, such as bumps or fins, to induce mixing. In some cases, an intake throttle is used to increase the pressure differential between the EGR gas and the compressed fresh air to drive more EGR gas, as needed. Yet restrictions in the EGR circuit regarding fresh air flow and EGR flow may still occur.

Figure 3:
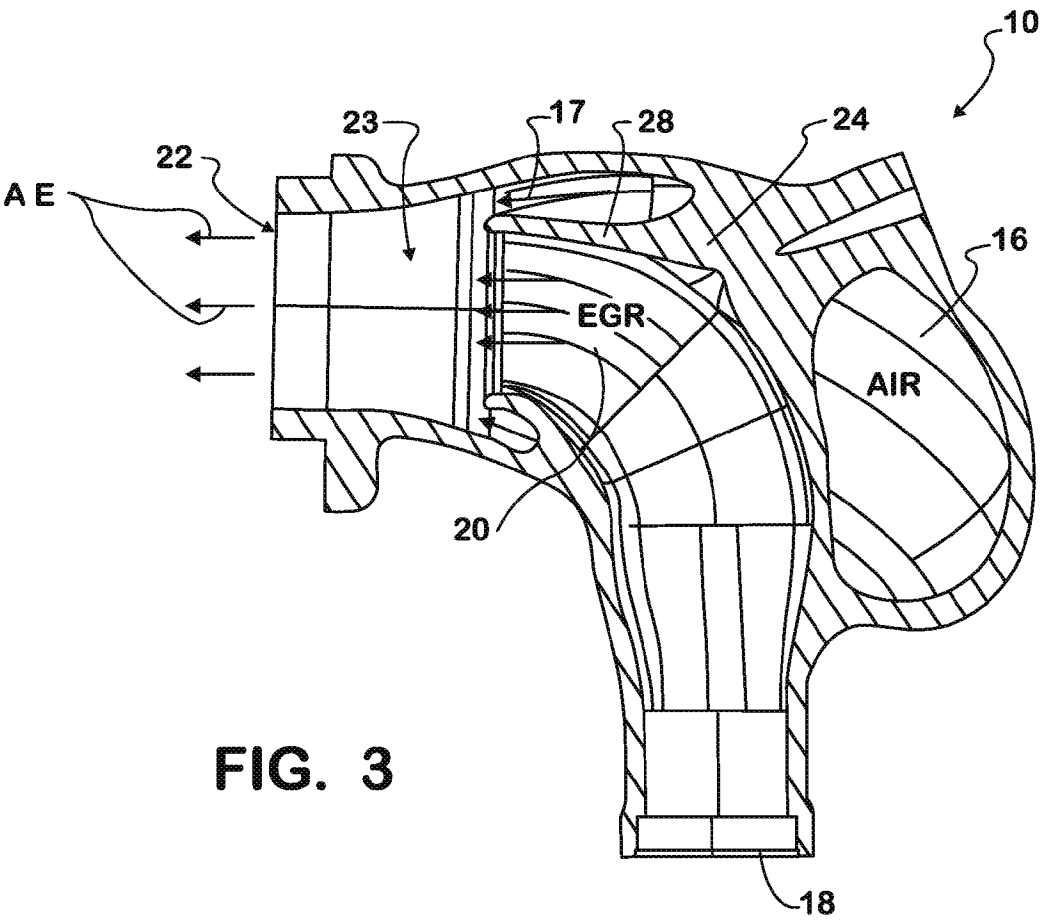
FIG. 3 is a side view of the present EGR air-exhaust mixer taken along lines A-A of FIG. 2.
Figure 4:
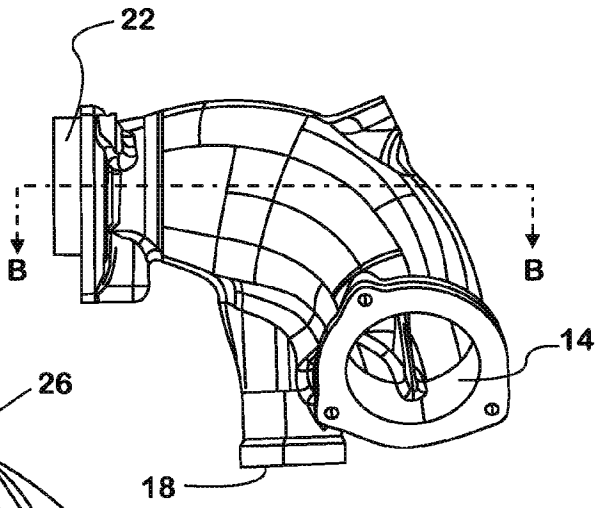
FIG. 4 is a side sectional view of the present EGR air-exhaust mixer.
Figure 5:
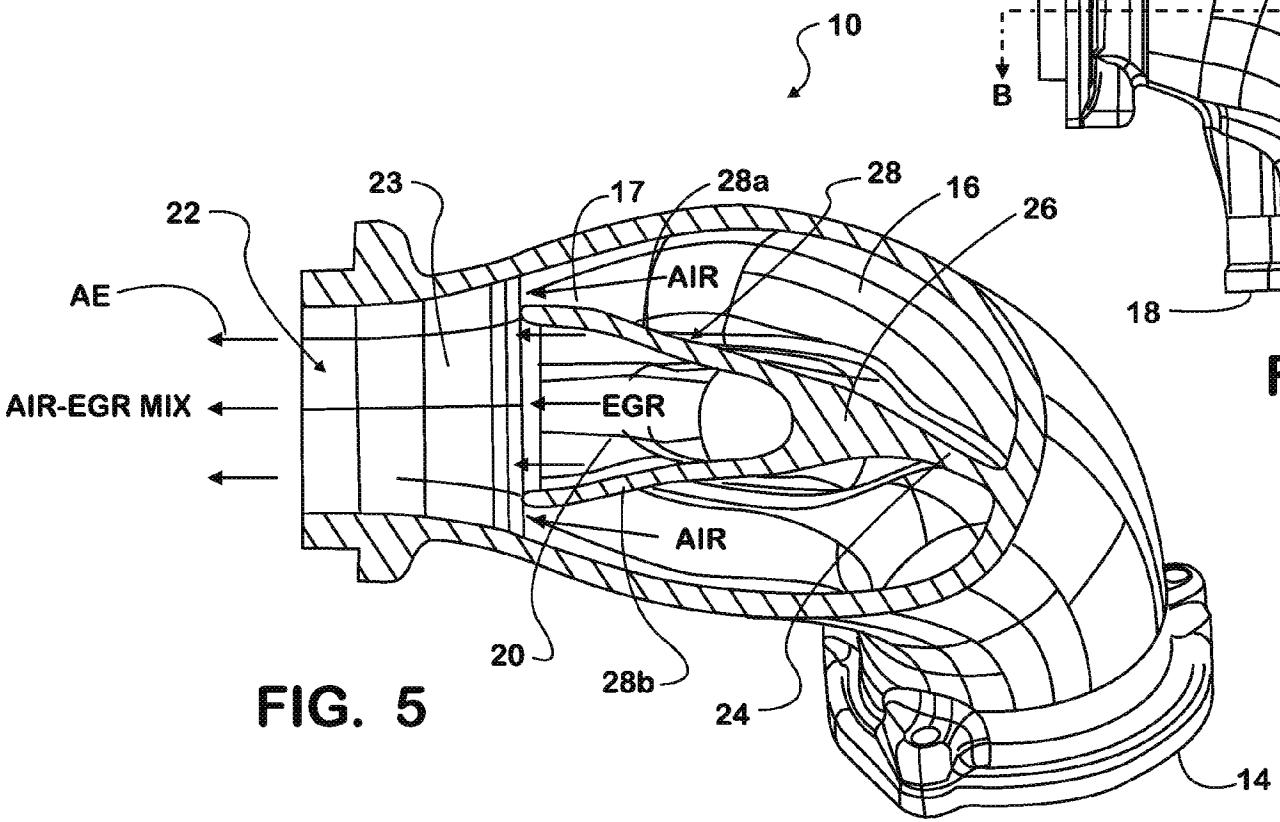
FIG. 5 is a top sectional view of the present EGR air-exhaust mixer taken along lines B-B of FIG. 4.
Figure 6:
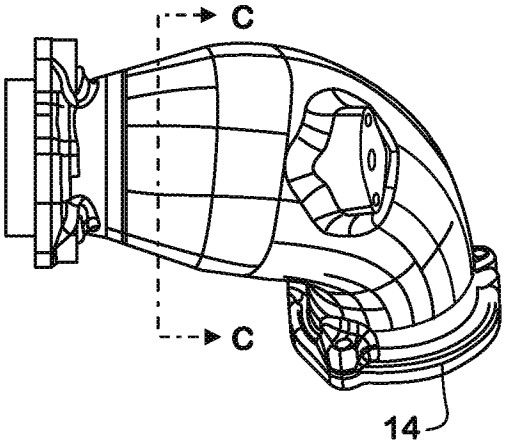
FIG. 6 is a top view of the present EGR air-exhaust mixer.

As shown in FIGS. 2-7, the present mixer 10 includes within the air passage 16 a bifurcation 24 or air distribution rib. The bifurcation 24 is disposed within the interior air passage 16 and maintains a uniform flow of air as it curves around the internal air passage. The bifurcation 24 generally has main section 26 connected to a widening branch section 28, having at least two branches or legs 28*a* and 28*b*. As shown in FIGS. 3 and 5, the branches or legs 28*a*, 28*b* of the branch section 28 separate away from one another as the bifurcation 24 develops downstream within the air passage. As the distance separating the legs 28*a*, 28*b* increases, the cross sectional area 17 of the air passage 16 narrows as it reaches the air-EGR mixture outlet 22.

It should be understood that the bifurcation 24 can have any geometry suitable to meet the requirements of a particular system, including but not limited to a curved or straight geometry. In addition, the amount of reduction of the cross section 17 likewise can vary depending on a particular system, since changes in the cross section will vary the velocity of the resulting air stream. It is believed that the reduced cross section 17 causes an increase in air velocity creating a vacuum, or venturi effect, that pulls EGR exhaust gas out while encouraging mixing at the mixing zone 23 of the air-EGR mixture outlet 22.

Figure 7:
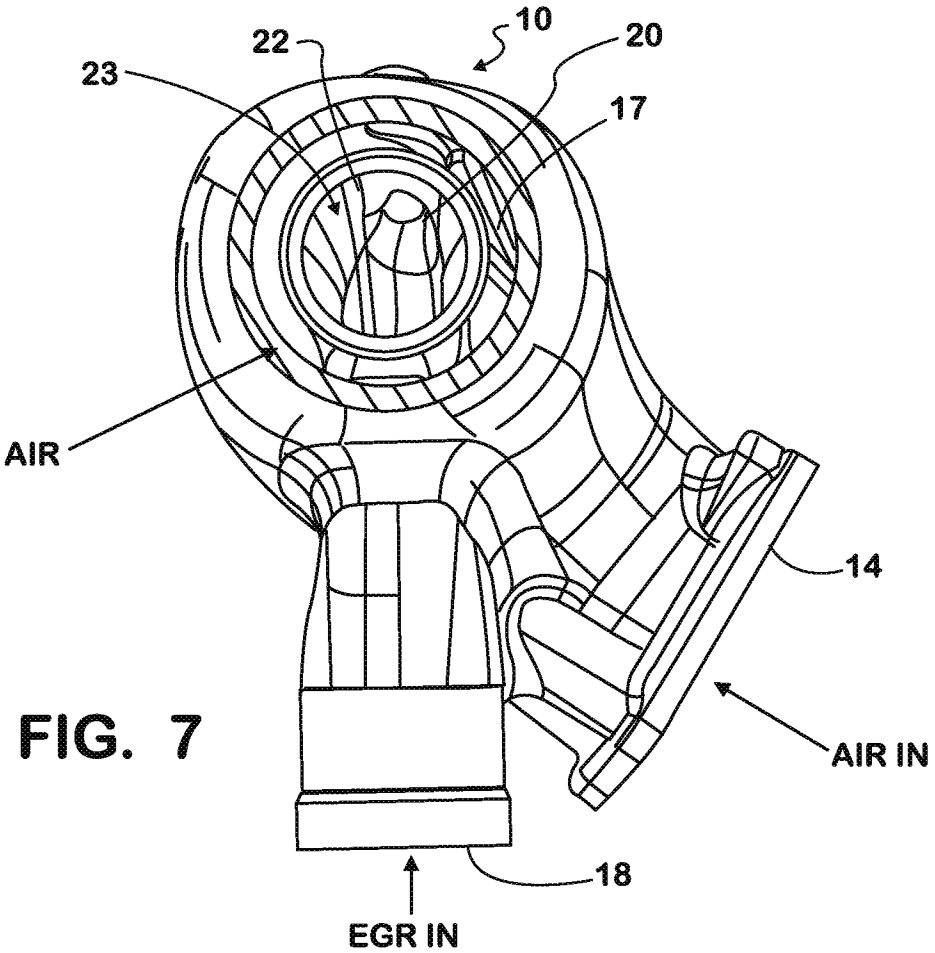
FIG. 7 is a front sectional view of the present EGR air-exhaust mixer taken along lines C-C of FIG. 6.

As shown in FIGS. 5 and 7, in addition to the bifurcated air flow passage, the present mixer 10 also includes a centrally located exhaust passage 20. After entering the mixer 10 through the exhaust gas inlet 18, exhaust gases travel through the mixer by the exhaust passage. The exhaust passage 20 maintains a relatively consistent diameter throughout the mixer. Centralized delivery of EGR gases creates sufficient initial distribution into the air stream, and subsequently enhances mixing of the exhaust gases with the fresh air stream leaving the narrowed crossed section 17 of the air passage 16. As noted, the venturi effect created by the fresh air stream passing through the narrowed cross section 17 encourages a greater volume of EGR gases to be pulled through the assembly by increasing the restriction of the fresh air stream to create the vacuum to pull the EGR gases through the mixer. Increasing the restriction of main air flow reduces the pressure ahead of the entering EGR, which either increases EGR flow or reduces the $\Delta P$ (pressure differential) required to drive EGR flow.

The present disclosure also provides a method for creating a mixture of exhaust gas with intake air for use in an exhaust gas recirculation device of an engine. Referring to FIGS. 1, 3 and 5, the arrows A represent the flow path of the fresh intake air, the arrows E represent the flow path of the exhaust gas, and the arrows AE represent the resulting mixture of air and exhaust exiting the mixer 10. The method comprises the steps of supplying fresh air through an air intake 14 to an air passage 16, supplying exhaust gas through an exhaust intake 18 to a centralized exhaust passage 20. The fresh air passage 16 includes a bifurcation 24, which divides the air flow through the air passage, creating a high velocity air flow through the air passage from the air intake to the mixing outlet 22.

In the present method, the step of bifurcating the air flow includes narrowing a cross section 17 of the air passage 16 from the air intake 14, wherein the narrowest section is at the mixing outlet 22. The step of bifurcating the air flow and narrowing the cross section 17 of the air passage 16, creates a vacuum at the mixing zone 23, wherein the vacuum accelerates a flow of exhaust gas through the exhaust passage. The narrowing cross section 17 creates a venturi effect on the flow of air through the assembly. The method also includes the step of mixing the air from the air passage 16 with the exhaust gas from the exhaust passage 20 effectively creating an air-exhaust gas mixture within the mixing zone 23 prior to returning the mixture to the engine.

What is claimed is:

1. An air-exhaust mixer comprising:

a main body;

an air inlet for receiving fresh air fluidly connected to an air intake passage within the main body;

an exhaust gas inlet for receiving exhaust fluidly connected to a exhaust gas passage within the main body;

a bifurcation within the air intake passage for directing the flow of air through the passage, wherein the bifurcation is a rib structure that includes a main section connected to a widening branch section that is widest at a mixture outlet, and wherein the bifurcation decreases a cross section of the air intake passage downstream from the air inlet increasing the air velocity exiting the air intake passage;

and, the mixture outlet fluidly connected to air intake passage and the exhaust gas passage for combining the air with the exhaust gas prior to exiting the mixer.

2. The mixer of claim 1, wherein the air inlet is separately positioned from the exhaust gas inlet on the main body.

3. The mixer of claim 1, wherein the exhaust gas passage is centrally located within the main body.

4. The mixer of claim 3, wherein the exhaust gas passage centrally disperses the exhaust gas through the main body to the mixture outlet.

5. The mixer of claim 1, wherein the branch section directs the air flow around the central gas passage.

6. The mixer of claim 5, wherein the branch section narrows the cross section of the downstream air intake passage creating a vacuum.

* * * * *